United States Patent [19]

Beachley et al.

[11] Patent Number: 5,067,456

[45] Date of Patent: Nov. 26, 1991

[54] HYPOCYCLOID ENGINE

[76] Inventors: Norman H. Beachley, 2332 Fitchburg Rd., Verona, Wis. 53593; Frank J. Fronczak, 238 Carillon Dr., Madison, Wis. 53705

[21] Appl. No.: 614,208

[22] Filed: Nov. 16, 1990

[51] Int. Cl.[5] ..... F02B 75/32

[52] U.S. Cl. ..... 123/197 AC

[58] Field of Search ..... 123/197 R, 192 B, 197 AC

[56] References Cited

U.S. PATENT DOCUMENTS

| | | | |
|---|---|---|---|
| 4,026,252 | 5/1977 | Wrin | 123/197 R |
| 4,073,196 | 2/1978 | Dell | 123/197 R |
| 4,485,768 | 12/1984 | Heniges | 123/197 R |
| 4,554,893 | 11/1985 | Vecellio | 123/195 S |
| 4,712,436 | 12/1987 | Brown | 123/192 B |

*Primary Examiner*—David A. Okonsky

*Attorney, Agent, or Firm*—Andrus, Sceales, Starke & Sawall

[57] ABSTRACT

An internal combustion engine utilizing hypocycloid movement has a crankshaft having a small crank pin construction wherein the piston rod end is supported rotatably on an eccentric disc which, in turn, is journalled for rotation on the crankpin. A rigid interconnected subassembly of the eccentric disc, counterweights and a pinion gear is rotatably mounted on the crankpin in a manner to distribute the piston loads to the opposite pin ends, thereby reducing crankpin bending stresses. The main crankshaft support bearings are located directly adjacent the crankpin ends, thereby further reducing crankpin bending stresses. A two-piece crankshaft construction allows the crankshaft to be preassembled for machining, disassembled for mounting the piston subassembly thereon, and reassembled. The modified hypocycloid gearing assembly includes a rotatable internal ring gear transmitting a portion of the torque produced by the piston force to the output shaft via the pinion gear and an idler gear and sun gear assembly. The remaining portion of the torque produced by the piston force is transmitted directly through the crankshaft. An adjustable idler gear mounting allows the modified gear assembly to be adjusted to compensate for gear tooth backlash.

13 Claims, 3 Drawing Sheets

FIG. 2
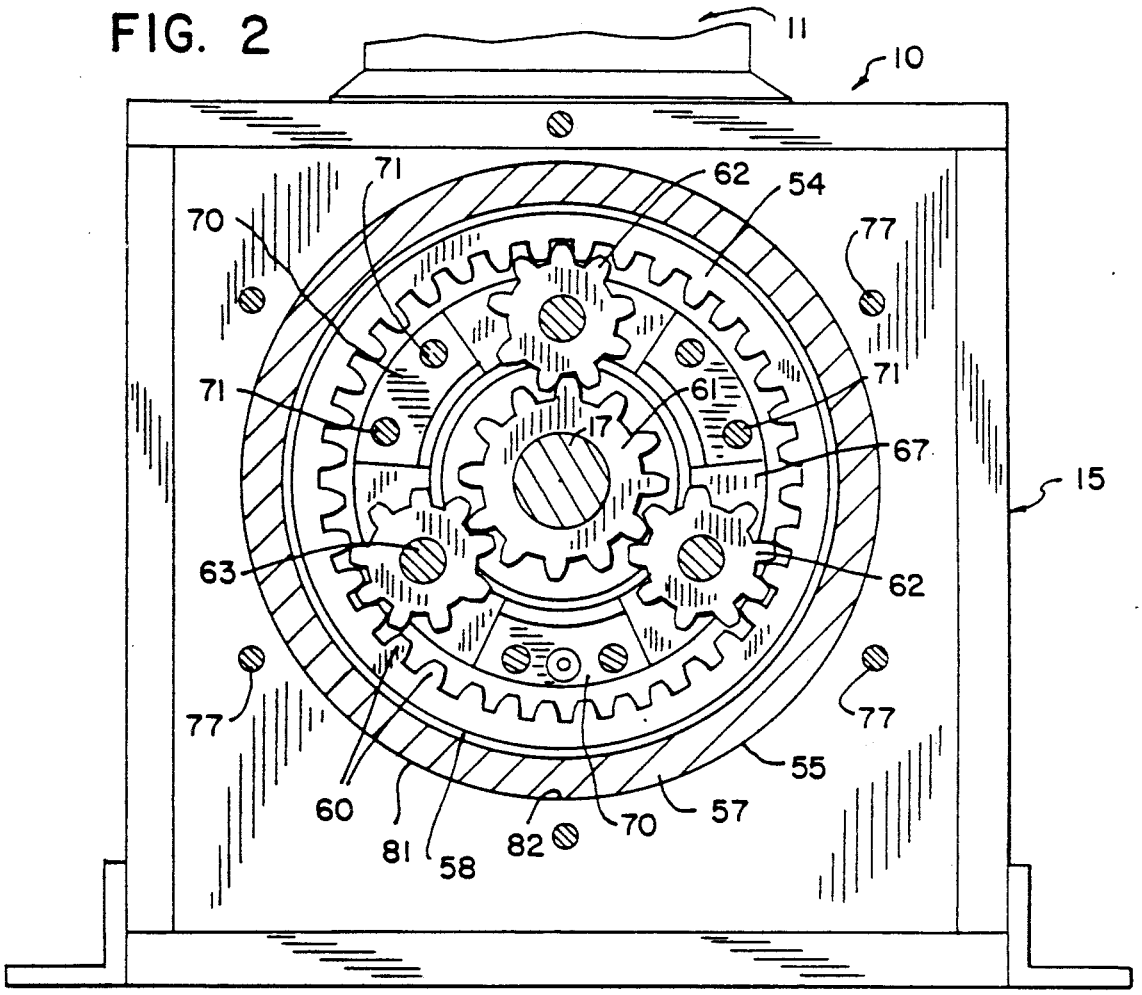
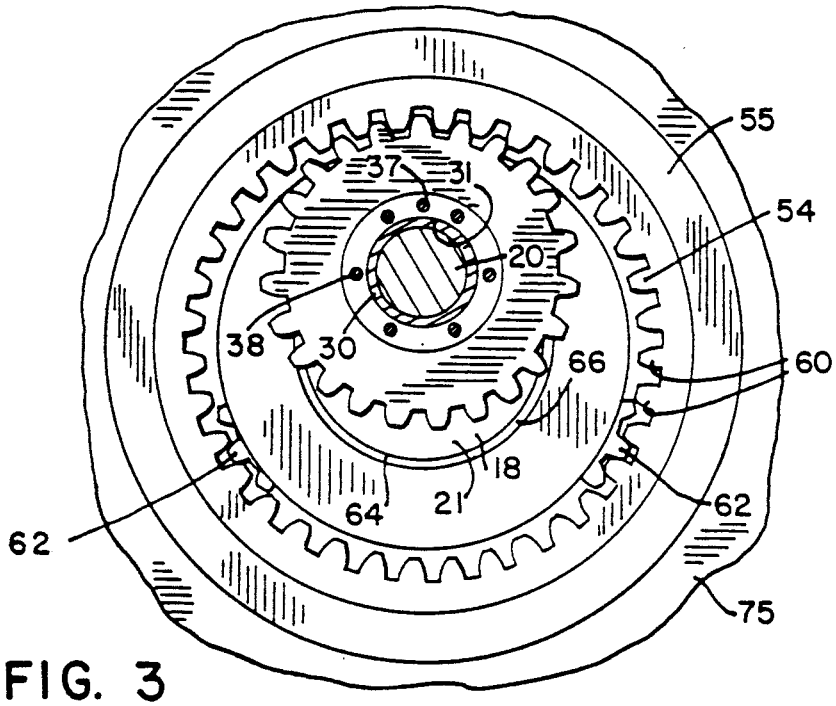
FIG. 3

HYPOCYCLOID ENGINE

BACKGROUND OF THE INVENTION

The present invention pertains to a construction for an internal combustion engine utilizing geared hypocycloid motion and, more particularly, to such an engine construction including improved assembly, load distribution, and adjustment features.

The principles of hypocycloid motion have long been applied to the design of internal combustion engines. The use of a hypocycloid gearing system provides straight line piston motion and a significant number of resultant advantages. These advantages include perfect engine balance (even in a single cylinder engine), elimination of a piston wrist pin and piston skirt, and an overall reduction in piston friction by the virtual elimination of piston side loading.

Basic hypocycloid design, utilizing a fixed internal ring gear which is engaged by a pinion gear mounted on the crankshaft, often results in undesirable gear loadings and may be particularly unsuitable for use in diesel engines and other supercharged engines. As a result, a myriad of designs have been proposed to provide modified gearing arrangements which still provide the basic hypocycloid motion, but better distribute the transmission of piston force to the crankshaft. Although many variations in gear arrangements are possible, two basic designs of modified hypocycloid engines have emerged. One utilizes a crankshaft with a heavy, large diameter eccentric on which is rotatably mounted a larger eccentric disc to carry the piston rod and the other utilizes a more conventional crankshaft construction having a smaller crankpin on which is rotatably mounted a moderately sized eccentric disc to carry the piston rod. Examples of the former construction are shown in U.S. Pat. No. 4,237,741. The large mass main eccentric, characteristic of this construction, introduces substantial weight problems, inherent in the large eccentric itself and in the similarly large counterweights which must be utilized to provide engine balance. This further results in practical limitations on the length of piston stroke. These problems are obviated in the alternate construction utilizing a small crankpin and eccentric disc, as shown, for example, in U.S. Pat. No. 3,563,222. However, this design introduces other problems. First of all, the need to assemble the eccentric disc, pinion gear and counterweights on the crankpin for rotation thereon requires a composite crankshaft construction or split pinion gear, connecting rod and eccentric disc which can be taken apart and reassembled. In addition, the piston force may result in unacceptably high loadings on the smaller crankpin.

Both basic designs of modified hypocycloid engines require the use of supplemental gearing arrangements which inherently introduce alignment problems as a result of gear backlash. The elimination of backlash by precise machining and assembly is impractical and, as a result, some means of adjusting the gearing after assembly is desirable.

SUMMARY OF THE INVENTION

The present invention is directed to improvements in hypocycloid engine construction, including a modified hypocycloid engine utilizing a crankshaft having a relatively small crankpin. The improvements in crankshaft construction and assembly may be utilized in conventional hypocycloid engines or engines utilizing a modified hypocycloid gearing arrangement. The present invention also includes a gear adjustment mechanism for one type of modified hypocycloid engine construction.

A demountable, composite crankshaft assembly of the present invention includes a main output shaft including a first cylindrical crankpin support coaxially attached to one end thereof, a stub shaft axially aligned with the output shaft and having a second cylindrical crankpin support coaxially attached to one end thereof. A cylindrical crankpin is attached by its ends to extend between the first and second crankpin supports with its axis offset from and parallel to the common axis of the output and stub shafts. A subassembly including an eccentric piston rod mounting ring, a pinion gear and counterweight means are attached together and journalled for rotation on the crankpin via crankpin bearing means rotatably supporting the subassembly on the crankpin. The bearing means is constructed and positioned to transmit the radial piston load imposed on the piston rod mounting ring axially along the crankpin to the ends thereof closely adjacent the crankpin supports. The first and second cylindrical crankpin supports provide bearing surfaces for the main support bearings rotatably mounting the crankshaft assembly in the engine crankcase. The main support bearings are disposed directly adjacent the respective opposite ends of the crankpin.

In accordance with the preferred embodiment of the crankshaft, the output shaft, the first cylindrical crankpin support and the crankpin comprise an integral first crankshaft piece and the stub shaft and the second cylindrical crankpin support comprise an integral second crankshaft piece, with means for demountably interconnecting the first and second crankshaft pieces. The first and second crankshaft pieces are interconnected by the use of an interference fit between the cylindrical end of the crankpin and a counterbore in the adjacent face of the second crankpin support. The end of the crankpin is also provided with a tapered counterbore into which a connecting pin is forcibly insertable to expand the outer surface of the crankpin surrounding the counterbore into tight interference locking engagement with the interior of the counterbore in the second crankpin support. The counterbore in the end of the crankpin is preferably tapered and the outer surface of the connecting pin is likewise provided with a matching taper.

The crankshaft assembly also includes means for forcibly removing the connecting pin from locking engagement to allow disassembly of the crankshaft. Preferably, the connecting pin disassembly means includes a tapped bore extending axially through the connecting pin, an access hole through the second crankpin support axially aligned with the tapped bore, and a jackscrew threadably mounted in the tapped bore to extend into engagement with the bottom of the counterbore in the crankpin, which jackscrew is accessible through the access hole. Alternately, the access hole may be adapted for connection to a suitable source of fluid pressure for pressurizing the interior of the counterbore to drive the pin out.

The crankpin bearing means, rotatably supporting the subassembly on the crankpin, preferably comprises a single piece bearing with a center groove to direct the loads to the opposite ends of the crankpin. The pinion gear, comprising part of the interconnected subassembly, rotatably mounted on the crankpin is preferably located directly adjacent the inside face of the first crankpin support. Internal ring gear means is journalled for rotation within the crankcase on the axis of the output shaft and includes a first internal gear in engagement with the pinion gear, a second internal gear axially spaced from the first internal gear and disposed adjacent the outside face of the first crankpin support, and means for interconnecting the first and second internal gears for common rotation. A sun gear is mounted on the output shaft for rotation therewith and in radial alignment with the second internal gear. Idler gear means are rotatably mounted to the crankcase and interposed between to drivingly interconnect the second internal ring gear and the sun gear. Preferably, the internal ring gear means comprises a unitary internal ring gear such that the first and second internal ring gears are identical axially spaced portions of the same unitary ring gear. The idler gear means preferably comprises a plurality of idler gears mounted on a mounting circle which is concentric with the common axis of the output shaft and the internal ring gear.

Adjustment of the gear assembly is provided by rotatably mounting each idler gear on an idler gear shaft with said shafts in turn attached to an adjustment ring having an adjustment surface concentric with the idler gear mounting circle and rotatably supporting the ring in the crankcase for rotationally adjusting the position of the idler gears on the mounting circle. Means are also provided for locking the idler gear adjustment ring in the crankcase in its adjusted position.

BRIEF DESCRIPTION OF THE DRAWINGS

FIG. 2 is a vertical section taken on line 2—2 of FIG. 1.

FIG. 3 is a partial vertical section through the engine taken on line 3—3 of FIG. 1.

DETAILED DESCRIPTION OF THE PREFERRED EMBODIMENTS

Figure 1:
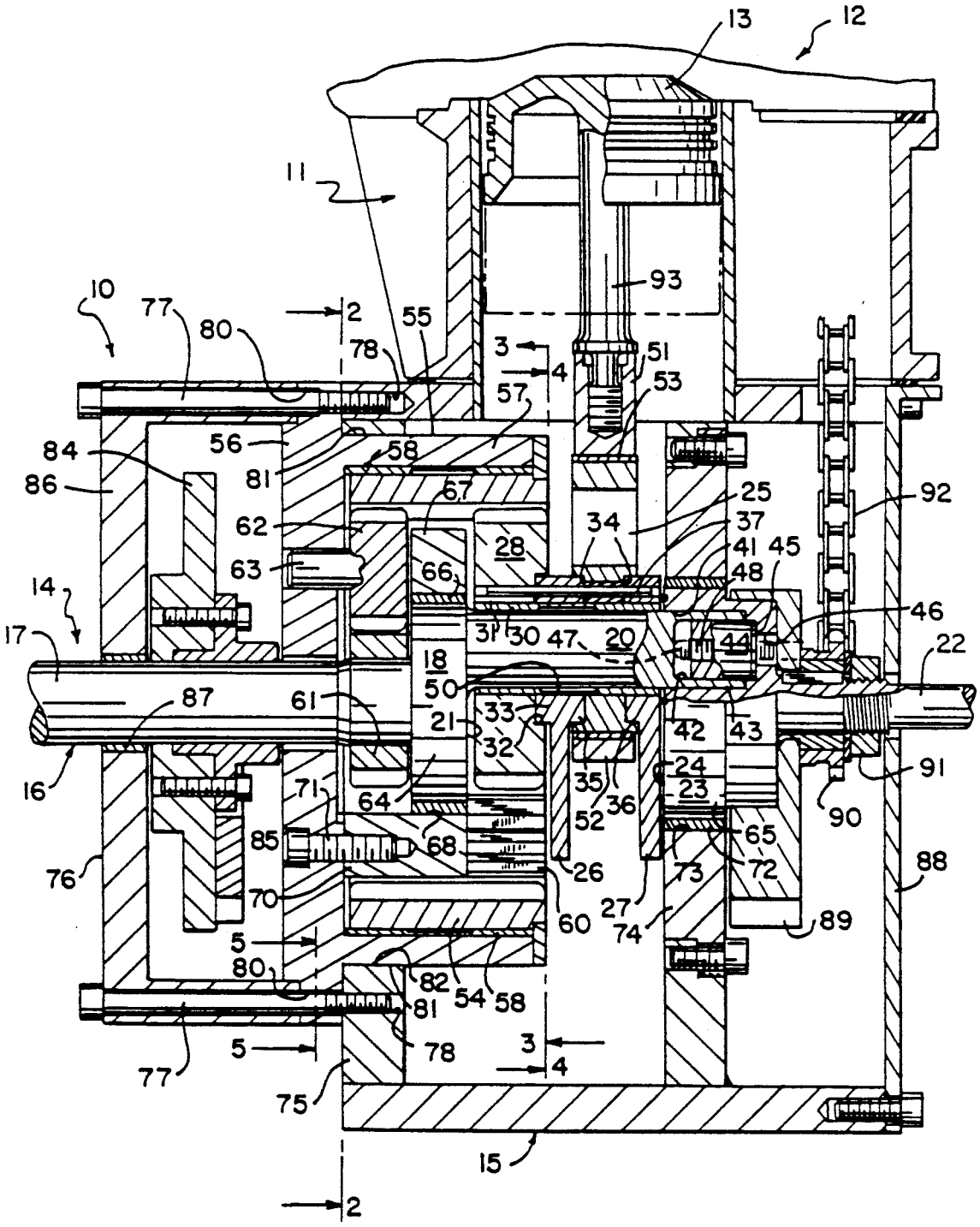
FIG. 1 is a vertical section through an internal combustion engine utilizing the modified hypocycloid mechanism of the present invention.

The present invention is shown and described in the embodiment of a single cylinder internal combustion engine, but the features of the invention described herein are applicable as well to multicylinder engines. Referring particularly to FIG. 1, the overall construction of the engine includes a lower crankcase assembly 10, an intermediate cylinder block assembly 11, and an upper cylinder head assembly 12. Only a part of the head assembly is shown and, preferably, includes an overhead cam assembly for operating the valves (none of which is shown). In FIG. 1, as well as in certain other drawing figures, the piston 13 is shown in the top dead center position.

The crankshaft assembly 14 of the present invention forms a part of the lower crankcase assembly 10 and is rotatably supported in a crankcase 15. The crankshaft assembly 14 includes a two piece crankshaft 16 which may be initially assembled, disassembled and subsequently reassembled to facilitate machining and the assembly of the remaining components of the crankshaft assembly.

The first integral piece of the crankshaft comprises a main output shaft 17, a first cylindrical crankpin support 18 and a crankpin 20 attached at one end to the inside face 21 of the first crankpin support 18 with the axis of the crankpin disposed offset from and parallel to the axis of the output shaft 17. The second crankshaft piece includes a stub shaft 22 and a second cylindrical crankpin support 23 to the inside face 24 of which the other end of the crankpin 20 is demountably attached. In the assembled crankshaft, the stub shaft 22 is axially aligned with the output shaft 17. The crankpin 20 extends between the parallel inside faces 21 and 24 of the first crankpin support 18 and second crankpin support 23, respectively.

Journalled for rotation on the crankpin 20 is an interconnected subassembly including an eccentric piston rod mounting disc 25, a pair of first and second inner counterweights 26 and 27, respectively, and a pinion gear 28. The subassembly is rigidly interconnected to rotate as a unit on the crankpin 20. A crankpin journal bearing 30 rotatably supports the subassembly for rotation on the crankpin 20.

Figure 4:
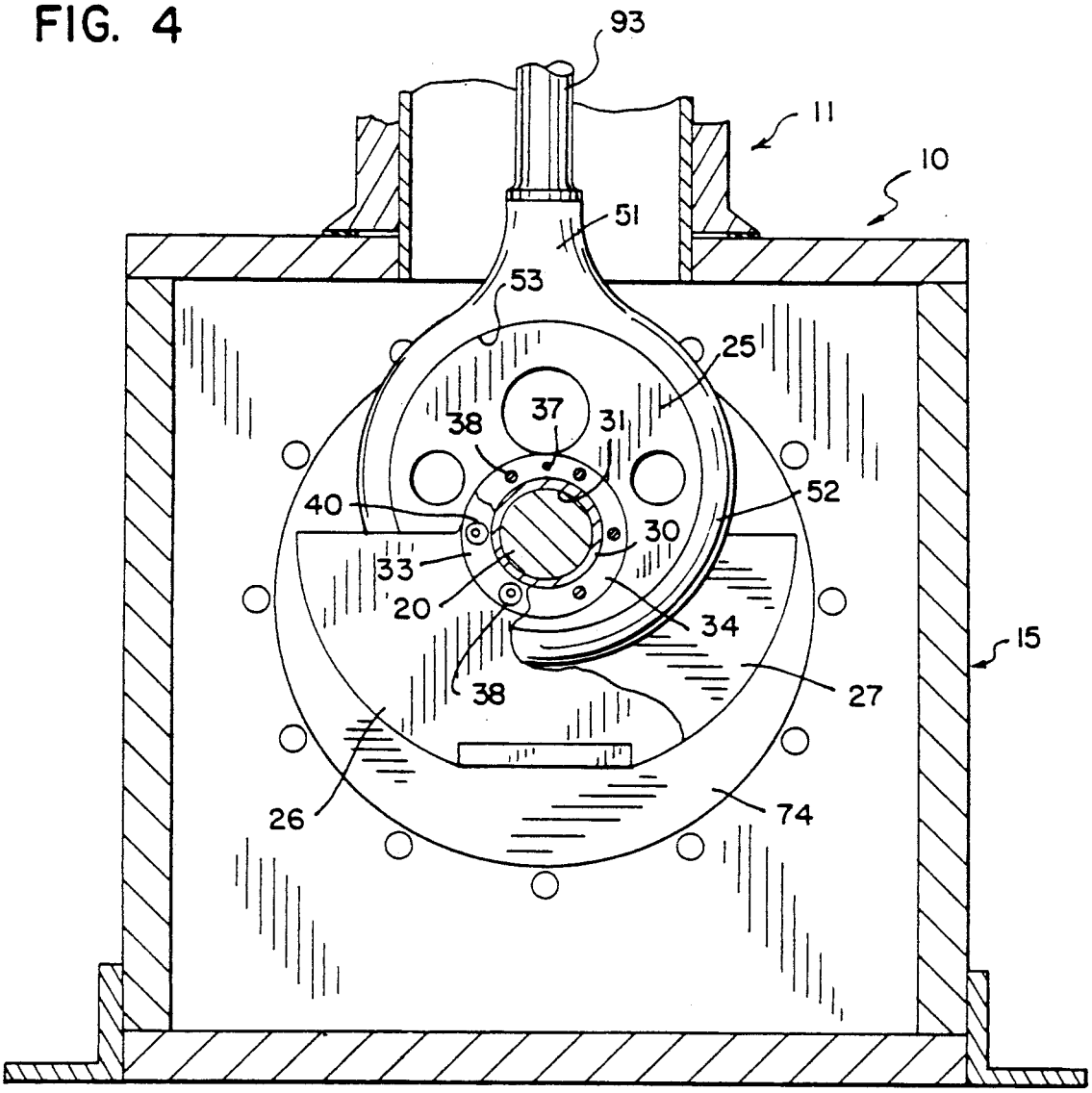
FIG. 4 is a vertical section through the engine taken on line 4—4 of FIG. 1.

The subassembly comprising the eccentric disc 25, counterweights 26 and 27, and pinion gear 28 is preassembled to place the component parts in precise relative alignment to one another. Each of the components of the subassembly includes a center mounting bore which together provide a common subassembly bore 31 for receipt of the crankpin bearing 30. One face of the pinion gear 28 is provided with a shallow counterbore 32 adapted to receive with a locational fit a first cylindrical shoulder 33 on one face of the first inner counterweight 26. The eccentric disc 25 is also provided with a pair of oppositely facing shallow counterbores 34 one of which is adapted to receive a second cylindrical shoulder 35 on the first inner counterweight 26 and the other of which is adapted to receive a cylindrical shoulder 36 on the inner face of the second inner counterweight 27, both with locational fits. This preliminary assembly establishes the common subassembly bore 31 and accurate rotational positioning of the components is established by a positioning pin 37 extending through aligned positioning holes in each of the components of the subassembly. Referring to FIG. 4, the aligned subassembly is held together by a series of mounting bolts 38 extending axially through aligned mounting holes in each of the pinion gear 28, first inner counterweight 26, eccentric disc 25 and second inner counterweight 27. The mounting bolt heads 40 may be recessed in the outside face of the pinion gear 28 and the opposite ends threaded into suitably tapped holes in the second inner counterweight 27.

To facilitate finishing and assembly of the entire crankshaft assembly 14, provision must be made, as previously indicated, for preliminary assembly, disassembly, and reassembly of the two piece crankshaft 16. As shown in FIG. 1, the inside face 24 of the second cylindrical crankpin support 23 is provided with a counterbore 41 having a diameter approximately equal to the outside diameter of the crankpin 20. The adjacent end of the crankpin 20 is also provided with a counterbore 42 of relatively large diameter to define at the end of the crankpin an integral annular sleeve 43. Preferably, the counterbore 42 is provided with a slight taper such that the counterbore narrows in an axially inward direction. A connecting pin 44 having a diameter and outside taper corresponding to the counterbore 42 is initially inserted partially into the counterbore 42 in the end of the crankpin 20. The end of the crankpin 20 is inserted into the counterbore 41 in the inside face of the second crankpin support 23 until it bottoms therein. A second counterbore 45 is provided in the bottom of counterbore 41 and is sized to loosely receive the exposed outer end of the connecting pin 44. The outside face of the second crankpin support 23 is provided with an access hole 46 opening into the second counterbore 45 and through which a suitable pin or other tool may be inserted to contact the connecting pin 44, whereby it may be driven further into the counterbore 42 in the end of the crankpin 20. Forcible movement of the connecting pin 44 into the counterbore causes the annular sleeve 43 to expand and increase the contact pressure with the cylindrical inside surface of the counterbore 41 in the crankpin support 23 to provide a uniform and extremely tight interference fit. Preferably, assembly of the crankshaft as just described is done in a suitable jig or fixture to maintain precise alignment of the component parts such that the output shaft 17 and stub shaft 22 are coaxial, and the axis of the crankpin 20 remains parallel to the common axis of shafts 17 and 22.

When so assembled, finish machining of the crankshaft 16, including grinding and the like, may be accomplished. However, after the crankshaft is machined, it must be disassembled to allow the crankpin bearing 30 and the subassembly of the eccentric disc 25, inner counterweights 26 and 27 and pinion gear 28 to be assembled axially on to the crankpin 20. To facilitate disassembly of the crankshaft, a jackscrew 47 may be threaded into a tapped through bore 48 in the connecting pin 44 with the jackscrew extending axially through the access hole 46 for engagement by a wrench or other tool on the outside of the crankshaft. By turning the jackscrew into contact with the bottom of the counterbore 42, the connecting pin is moved axially into contact with the bottom of the second counterbore 45 which eliminates the pressure creating the interference fit, and then forces the second crankpin support 23 and integral stub shaft from the crankpin. After the subassembly is mounted on the crankpin, reassembly of the crankshaft is effected in the same manner previously described.

The crankpin bearing 30 is divided axially either by providing the ID thereof with an annular oil groove 50 or by utilizing two separate bearings. In either case, the bearing load on the crankpin 20 resulting from the force exerted by the piston 13 is transmitted to the opposite ends of the crankpin respectively adjacent the inside face 21 of the first crankpin support 18 and the inside face 24 of the second crankpin support 23. Because these points of force transfer are directly adjacent the main bearing supports for the crankshaft, as will be described hereinafter, high bending stresses on the relatively small diameter crankpin are minimized. As may be clearly seen with reference to FIGS. 1 and 4, the force created by combustion driving the piston downwardly is transmitted to the piston rod end 51 which comprises a large diameter annular ring 52 journalled for rotation on the eccentric disc 25 with a suitable rod end bearing 53. The attachment force provided by the mounting bolts 38 securing the subassembly of the eccentric disc 25, inner counterweights 26 and 27 and pinion gear 28 allows the radially imposed piston force to be distributed axially through the subassembly and then through bearing 30 to the ends of the crankpin 20. In this manner, a large portion of the torque generated by the piston force is transferred directly to the output shaft 17 via the crankpin 20 and first crankpin support 18.

However, in accordance with the gearing arrangement provided by the modified hypocycloid construction of the present invention, a portion of the torque generated by the piston force is also transferred to the output shaft via a modified hypocycloid gearing arrangement. The pinion gear 28 is positioned to engage an internal ring gear 54 which is journalled for rotation within the crankcase 15. A ring gear support 55 includes an end plate 56 provided with a central hole through which the output shaft 17 extends and an integral heavy walled cylindrical tube 57 which extends axially along the crankshaft over the pinion gear 28. The internal ring gear 54 is journalled for rotation within the cylindrical tube 57 on a ring gear bearing 58. The ring gear bearing 58 may comprise a grooved cylindrical sleeve, similar to the crankpin bearing 30, but of a much larger diameter. The internal ring gear 54 has a substantial axial length such that the ring gear teeth 60 extend continuously from engagement with the pinion gear 28, over the first crankpin support 18 to an opposite axial end adjacent the inside face of the ring gear support end plate 56. That end of the ring gear 54 surrounds a sun gear 61 which is mounted for rotation with the output shaft 17 with driving interconnection between the internal ring gear and the sun gear provided by an array of idler gears 62. The idler gears are rotatably mounted on idler gear shafts 63 pressed into holes in the end plate 56 of the ring gear support 55 to define a mounting circle which is concentric with the axis of the crankshaft. Thus, a portion of the torque generated by the piston force directed to the crankpin is transmitted to the output shaft 17 via a gearing path comprising engagement of the pinion gear 28 with the internal ring gear 54, the ring gear with the idler gears 62, and the idler gears with the sun gear 61. The internal ring gear 54 and sun gear 61 rotate on the common axis of the crankshaft, but in opposite directions.

In a conventional hypocycloid gear assembly, the internal ring gear is rigidly attached to the crankcase and has a diameter equal to twice the diameter of the pinion gear. This ratio must be preserved to provide the true straight line motion of the piston. Piston force is transmitted directly to the crankshaft via a single path and the full equal reaction force is borne by the pinion and ring gears. The result is gear tooth loadings that are often too high to assure adequate gear life. In the modified construction of the present invention, the ratio of the diameters of the ring gear and pinion gear is substantially reduced, resulting in substantially reduced gear tooth loads and crankpin load. The overall reduced loadings are due in part to the change in gear ratio and the provision of a dual path for the transmission of torque produced by piston force to the output shaft.

The cylindrical outer surfaces 64 and 65 of the first and second crankpin supports 18 and 23, respectively, are journalled for rotation in the crankcase and provide the main crankshaft support bearings. Specifically, the cylindrical surface 64 of the first crankpin support is journalled for rotation in a first crankshaft bearing 66 mounted in a bearing housing 67. An axial bore 68 through the bearing housing 67 provides the outer race for the first crankshaft bearing 66. Three integral circumferentially spaced and axially extending mounting lugs 70 on the housing 67 are attached directly to the inside face of the end plate 56 of the ring gear support 55 by mounting bolts 71. The circumferential spaces between the mounting lugs 70 provide clearance for the idler gears 62, as may best be seen in FIG. 2. The cylindrical surface 65 of the second crankpin support 23 is supported for rotation in a second crankshaft bearing 72 housed in a suitable axial bore 73 in one main crankcase bulkhead 74. By utilizing the crankpin supports 18 and 23 as the journals of the first and second crankshaft bearings 66 and 72, respectively, the support for forces in reaction to the crankpin loads are located directly adjacent the points on the ends of the crankpin 20 to which the piston loads are distributed. This also significantly reduces bending stress in the crankpin.

Figure 5:
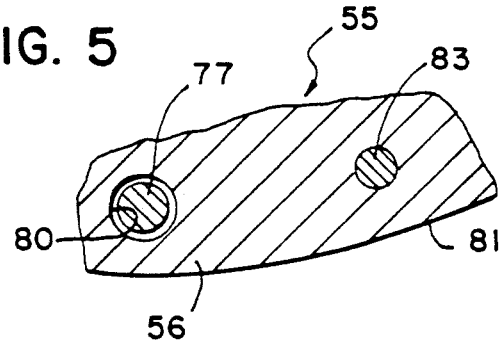
FIG. 5 is an enlarged partial section taken on line 5—5 of FIG. 1.

As will be apparent from the foregoing description, the ring gear support 55 also provides direct support for the housing 67 for the first crankshaft bearing 66 as well as support for the idler gears 62. The ring gear support 55 is attached directly to the output end crankcase bulkhead 75, along with a fly wheel cover 76, by a set of long mounting bolts 77 threaded into suitably tapped holes 78 in the bulkhead 75. Referring also to FIG. 5, enlarged clearance holes 80 are provided in the ring gear support 55 for passage of the mounting bolts 77. The clearance holes 80 are made sufficiently over-sized with respect to the diameters of the mounting bolts 77 to allow a slight amount of rotational adjustment of the ring gear support 55. Specifically, the outer cylindrical surface 81 of the integral cylindrical tube 57 on the ring gear support is received in a large circular opening 82 in the output end bulkhead 75. The circular opening 82 is sized to receive the cylindrical tube 57 to support the same for slight rotational movement therein. By rotationally adjusting the ring gear support and thereby automatically adjusting the circumferential positions of the idler gears 62 with respect to the inter-engaging ring gear 54 and sun gear 61, gear backlash may be compensated for, thereby more nearly attaining perfect hypocycloid motion and true linear movement of the piston rod end 51. It is likely that maximum rotational adjustment of only approximately 0.005 inch may be necessary, yet this amount of adjustment may be very significant in compensating for gear backlash. Once the exact rotational position of the ring gear support 55 and attached idler gears 62 is established, the long mounting bolts 77 are drawn up tightly. In addition, as shown in FIG. 5, the final position of the ring gear support may be positively held by inserting a positioning dowel 83 into aligned holes drilled and reamed in the ring gear support 55 and the bulkhead 75. A single pair of such aligned holes would be adequate and same may be conveniently located on the bolt circle for the mounting bolts 77 between one pair thereof.

Flywheel cover 76 conveniently houses the engine flywheel 84 to which first outer counterweight 85 is attached. The outer plate 86 of the flywheel cover 76 is provided with an opening for the output shaft 17 which may be rotationally supported therein by a suitable end bearing 87.

The opposite stubshaft end of the crankshaft is closed by a front cover 88 to enclose therein a second counterweight 89 and timing chain sprocket 90 both of which are keyed to the stubshaft 22 and held thereon by a stop nut 91. A timing chain 92 driven by sprocket 90 extends upwardly into the upper cylinder head assembly 12 to drive an overhead camshaft (not shown). The outer end of the stubshaft may also carry an ignition magneto (also not shown).

In an alternate construction, the internal ring gear 54 may be provided with separate tooth patterns for engaging, respectively, the pinion gear 28 and the idler gears 62. These different tooth patterns may comprise different size teeth (i.e., varying tooth pitch), different internal gear diameters (i.e., varying pitch diameters), or a combination thereof. The different internal ring gears may be formed entirely separately and bolted or otherwise fastened together to rotate in unison within a common ring gear bearing 58 or in separate bearings of the same or different diameters. Suitable adjustments in the diameters of the pinion gear, idler gears and sun gear would, of course, also be required.

Each of the crankpin bearing 30, rod end bearing 53, ring gear bearing 58, and crankshaft bearings 66 and 72 may comprise a type of bearing other than the plain cylindrical sleeve bearings described and shown. Suitable roller or ball bearings may be substituted for any or all of these bearings.

Because of the pure linear reciprocating motion of the piston rod end 51 and the elimination of a conventional wrist pin, the piston 13 and piston rod 93 may be constructed of a single piece, as shown. The piston rod 93 may be suitably threaded for direct attachment to a suitably tapped hole in the piston rod end 51, as shown in FIG. 1.

This construction of the piston rod/rod end connection removes the threaded joint from the higher temperature region at the piston head. Thermal expansion problems potentially affecting the joint are thereby minimized. Also, joint locking compounds, nylon inserts, and the like which cannot tolerate high temperatures may be used to secure the threaded joint. The integral piston and piston rod may be made of a different material than the rod end, if desired.

Various modes of carrying out the present invention are contemplated as being within the scope of the following claims particularly pointing out and distinctly claiming the subject matter is regarded as the invention.

We claim:

1. A crankshaft assembly a hypocycloid engine, said assembly rotatably supported in an engine crankcase and comprising:

a main output shaft;

a first cylindrical crank support attached to an inner end of the output shaft coaxially therewith;

a second cylindrical crankpin support attached to an inner end of a stub shaft coaxially therewith;

a cylindrical crankpin extending between and attached by its opposite ends to the first and second crankpin supports, the axis of the crankpin disposed offset from and parallel to a common axis of the output and stub shafts;

a fixedly interconnected subassembly including an eccentric piston rod mounting disc, a pinion gear and counterweight means journalled for rotation on said crankpin, said subassembly including means for interconnecting said mounting disc, pinion gear and counterweight means;

crankpin bearing means rotatably supporting said subassembly on said crankpin, said bearing means positioned to distribute a radial load on said piston rod mounting disc to the ends of the crankpin closely adjacent said crankpin supports; and first and second support bearings respectively rotatably mounting said first and second crankpin supports in the crankcase directly adjacent the ends of the crankpin.

2. The assembly as set forth in claim 1 wherein said output shaft, first crankpin support and crankpin comprise an integral first crankshaft piece, and said stub shaft and second crankpin support comprise an integral second crankshaft piece, and further including means for demountably interconnecting said first and second crankshaft pieces.

3. The assembly as set forth in claim 2 wherein said interconnecting means comprises:

axially aligned counterbores in the end of the crankpin and the adjacent face of the second crankpin support, the counterbore in the face of said second crankpin support sized to receive therein the adjacent end of said crankpin; and, connecting pin means forcibly insertable into the counterbore in the end of the crankpin to expand an outer surface of said crankpin into locking engagement with the interior cylindrical surface of the counterbore in said second crankpin support.

4. The assembly as set forth in claim 3 wherein the counterbore in said crankpin end and the engaging outer peripheral surface of said connecting pin are provided with matching tapers.

5. The assembly as set forth in claim 4 including means for forcibly removing said connecting pin from locking engagement.

6. The assembly as set forth in claim 5 wherein said removing means comprises:

a tapped bore extending axially through said connecting pin;

an access hole through said second crankpin support axially aligned with said tapped bore; and, a jackscrew threadably mounted in said tapped bore to extend therethrough into engagement with the bottom of the counterbore in said crankpin and accessible through said access hole.

7. The assembly as set forth in claim 1 wherein said crankpin bearing means comprises a pair of crankpin bearings disposed on opposite ends of said crankpin.

8. The assembly as set forth in claim 1 wherein said pinion gear is disposed directly adjacent an inside face of said first crankpin support, and further comprising:

internal ring gear means journalled for rotation within the crankcase on the axis of the output shaft, said ring gear means including a first internal gear in engagement with said pinion gear, a second internal gear axially spaced from said first internal gear and adjacent the outside face of said first crankpin support, and means for interconnecting said first and second internal gear for common rotation;

a sun gear mounted on said output shaft for rotation therewith, said sun gear aligned and concentric with said second internal gear; and, idler gear means rotatably mounted to the crankcase and drivingly interconnecting said second internal ring gear and said sun gear.

9. The assembly as set forth in claim 8 wherein said internal ring gear means comprises a unitary internal ring gear.

10. The assembly as set forth in claim 9 wherein said first and second internal ring gears comprise identical portions of said unitary ring gear.

11. The assembly as set forth in claim 8 wherein said idler gear means comprises a plurality of idler gears mounted on a mounting circle concentric with the common axis of said output shaft and said internal ring gear means.

12. The assembly as set forth in claim 11 wherein said idler gears are each rotatably mounted on an idler gear shaft, and said idler gear shafts are attached to an adjustment ring having a cylindrical adjustment surface concentric with the idler gear mounting circle and rotatably supporting the adjustment ring in the crankcase to adjustably position the idler gears on the mounting circle; and, means for locking said adjustment ring in the crankcase.

13. The assembly as set forth in claim 1 comprising:

an annular piston rod end journalled for rotation on the eccentric disc;

an integral piston and piston rod, said piston rod having an end remote from said piston; and, means for threadably connecting the end of said piston rod to said rod end.

* * * * *

UNITED STATES PATENT AND TRADEMARK OFFICE

CERTIFICATE OF CORRECTION

PATENT NO. : 5,067,456

DATED : 11-26-91

INVENTOR(S) : Norman H. Beachley et al

It is certified that error appears in the above-identified patent and that said Letters Patent is hereby corrected as shown below:

TITLE PAGE

ADD --ASSIGNEE: WISCONSIN ALUMNI RESEARCH FOUNDATION, MADISON, WISCONSIN--

Claim 1, column 8, line 39, after "assembly" insert --for--.

Claim 1, column 8, line 43, delete "crank" and substitute therefor --crankpin--.

Signed and Sealed this

Sixth Day of April, 1993

*Attest:*

STEPHEN G. KUNIN

*Attesting Officer*

*Acting Commissioner of Patents and Trademarks*